US010016782B2

(12) United States Patent
Bellis

(10) Patent No.: US 10,016,782 B2
(45) Date of Patent: Jul. 10, 2018

(54) SUBMERGED COATING REPAIR OF POTABLE WATER SYSTEMS

(71) Applicant: ADVANTAGE TECHNICAL SERVICES, INC., San Luis Obispo, CA (US)

(72) Inventor: William D. Bellis, San Luis Obispo, CA (US)

(73) Assignee: ADVANTAGE TECHNICAL SERVICES, INC., San Luis Obispo, CA (US)

( * ) Notice: Subject to any disclaimer, the term of this patent is extended or adjusted under 35 U.S.C. 154(b) by 0 days.

(21) Appl. No.: 15/720,169

(22) Filed: Sep. 29, 2017

(65) Prior Publication Data

US 2018/0085779 A1 Mar. 29, 2018

Related U.S. Application Data

(60) Provisional application No. 62/401,444, filed on Sep. 29, 2016.

(51) Int. Cl.
*B05D 7/14* (2006.01)
*B05D 7/22* (2006.01)
(Continued)

(52) U.S. Cl.
CPC ..... *B05C 17/10* (2013.01); *B05D 1/02* (2013.01); *B05D 1/26* (2013.01); *B05D 1/32* (2013.01);
(Continued)

(58) Field of Classification Search
CPC ... B05D 1/02; B05D 1/26; B05D 1/32; B05D 5/005; B05D 7/14; B05D 7/146;
(Continued)

(56) References Cited

U.S. PATENT DOCUMENTS 3,891,583 A 6/1975 Drisko et al.
4,195,001 A 3/1980 Lytton
(Continued)

FOREIGN PATENT DOCUMENTS

CN 102504738 A * 6/2012
DE 10026649 A1 * 12/2001 ..... G21C 19/07
KR 10128646180000 B1 * 7/2013

OTHER PUBLICATIONS

Quickset Watercrete, 17 pages. (Year: 2016).*
Underwater Concrete Repair Epoxy, 2 pages. (Year: 2015).*

*Primary Examiner* — William P Fletcher, III
(74) *Attorney, Agent, or Firm* — SoCal IP Law Group LLP; Guy L. Cumberbatch

(57) ABSTRACT

Systems and methods for safely repairing potable water tanks when submerged within a tank. The barrier may be shield structure defining a cavity and having an aperture and valve for injecting the coating material into the cavity, or the barrier may be a sheet preloaded with coating material and stored within and delivered via a transfer shield, or the barrier may be a continuous sheet delivered over the top of the coating material at the same time it is applied. The barrier layer, be it a shield structure sheet or continuous sheet, becomes adhered to the substrate being repaired so post cure removal is not required. Methods of repair include pressing the sealing edge of a barrier shield over an area, injecting coating material between the barrier shield and area, removing the source of coating material, and permitting the coating material to cure.

20 Claims, 3 Drawing Sheets

(51) Int. Cl.

| | |
|---|---|
| ***B05C 17/10*** | (2006.01) |
| ***B63C 11/52*** | (2006.01) |
| ***B05D 1/02*** | (2006.01) |
| ***B05D 1/26*** | (2006.01) |
| ***B05D 1/32*** | (2006.01) |
| ***B05D 5/00*** | (2006.01) |

(52) U.S. Cl.
CPC ..... *B05D 5/005* (2013.01); *B05D 7/14* (2013.01); *B05D 7/146* (2013.01); *B05D 7/148* (2013.01); *B05D 7/22* (2013.01); *B05D 7/222* (2013.01); *B05D 7/227* (2013.01); *B63C 11/52* (2013.01); *B05D 2254/04* (2013.01); *B05D 2259/00* (2013.01); *B05D 2504/00* (2013.01)

(58) Field of Classification Search
CPC ..... B05D 7/148; B05D 7/22; B05D 7/222; B05D 7/227; B05D 2254/04; B05D 2259/00; B05D 2504/00; B63C 11/52
USPC .... 427/140, 142, 230, 239, 287, 407.1, 409, 427/410, 427.1, 427.4, 427.5; 137/15.01, 137/15.08, 15.11
See application file for complete search history.

(56) References Cited

U.S. PATENT DOCUMENTS

| | | | | |
|---|---|---|---|---|
| 4,260,700 | A | 4/1981 | Cassutt et al. | |
| 4,793,162 | A | 12/1988 | Emmons | |
| 4,814,035 | A | 3/1989 | Turner | |
| 5,465,881 | A * | 11/1995 | Zwicky | B63C 11/52 222/389 |
| 6,363,681 | B1 | 4/2002 | Neuner | |
| 6,422,777 | B1 * | 7/2002 | Landrau | B05C 17/00516 222/566 |
| 7,871,483 | B2 | 1/2011 | Mullins et al. | |
| 8,925,168 | B2 * | 1/2015 | Srivatsan | B63B 59/00 29/402.01 |
| 9,666,314 | B2 * | 5/2017 | Kramer | G21C 19/02 |
| 2010/0192368 | A1 * | 8/2010 | Kramer | E04G 23/0218 29/824 |
| 2013/0145594 | A1 * | 6/2013 | Kramer | G21C 19/02 29/402.01 |

* cited by examiner

SUBMERGED COATING REPAIR OF POTABLE WATER SYSTEMS

RELATED APPLICATION INFORMATION

This patent claims priority to provisional application no. 62/401,444 filed Sep. 29, 2016, entitled "SUBMERGED COATING REPAIR OF POTABLE WATER SYSTEMS", which is incorporated herein by reference in its entirety.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

FIELD OF THE INVENTION

The present invention relates to systems and methods for safely repairing the submersed interior surfaces of potable water tanks and other portions of water systems.

BACKGROUND

Unsafe drinking water can have disastrous consequences. Therefore, the Environmental Protection Agency (EPA) sets standards for tap and public water systems in the United States under the Safe Drinking Water Act (SDWA). Potable water tanks are one key component of water systems, and eventually they develop coating failures or leaks. Keeping the different parts of a potable water system sufficiently maintained protects the integrity and dependability of the components and thus the water system. Taking water systems out of service and draining for maintenance is impractical and often prohibitively expensive. Spot repairs made with the system "in service" or with only minimal shutdown give water system operators a valuable tool for maintaining water infrastructure.

Diving is the most common method for inspection and repair of potable-water-storage-facilities. Divers wear industry standardized suits, so at no time does the body come in contact with the stored water. The American Water Works Association (AWWA) Standard for Disinfection of Potable Water Storage Facilities is one industry standard that governs this work. This standard requires that divers and equipment be sanitized with AWWA compliant chlorine solutions before entering the tank. Further, many states require that all components of a water treatment or distribution system be approved for potable water service pursuant to NSF/ANSI 61: Drinking Water System Components—Health Effects. However, current industry standard is to apply coatings underwater with potable water exposed to the uncured coating, although the uncured coating is not approved for contact with potable water. For instance, Liquivision Technology of Klamath Falls, Oreg., promotes diving services which include application of an underwater coating which comes into contact with the water prior to being cured, as seen on YouTube at https://www.youtube.com/watch?v=ppf8eYVXuec and other places.

Consequently, there remains a need for systems and methods for safely repairing potable water tanks and other portions of a water system when submerged within a full tank or system.

SUMMARY OF THE INVENTION

Systems and methods for safely repairing potable water tanks when submerged within a tank. Several methods using a barrier are used to separate the coating material, after application to the area of the tank needing repair, from the potable water. The barrier materials are safe for contact with potable water. The barrier may be shield structure defining a cavity and having an aperture and valve for injecting the coating material into the cavity, or the barrier may be a sheet preloaded with coating material and stored within and delivered via a transfer shield, or the barrier may be a continuous sheet delivered over the top of the coating material at the same time it is applied. The barrier layer, be it a shield structure sheet or continuous sheet, becomes adhered to the substrate being repaired so post cure removal is not required.

DETAILED DESCRIPTION

The present application provides improved systems and methods for safely repairing surfaces in potable water systems when submerged in potable water. The repair includes applying to the area of the tank needing repair a coating material, typically a two part, 100% solids epoxy or other material that has good adhesion in submersion and cures underwater. Suitable materials include Raven Lining Systems-Aquatapoxy or Rhino Linings 1409R-2, both two part 100% solids epoxies. These types of coating materials require a certain amount of time to cure prior to which they are toxic and regulations prohibit their contact with drinking water. Unfortunately, current industry practices involve simply applying the epoxy material over the area needing repair, even if the epoxy comes into contact with the potable water source.

In the embodiments described herein, a nontoxic barrier is used to prevent potable water from coming into contact with the epoxy coating material during curing. For instance, an underwater curing epoxy or other material may be injected or placed in advance (pre-loaded) between the substrate and the barrier in submersion for in situ repairs with none or de minimus contact during curing in order to eliminate or reduce contamination of the water. The term "de minimus contact" means that if water does come in contact with the uncured epoxy coating material, it only happens instantaneously prior to covering the coating material with the barrier. Preferably, any contact is less than a second in duration, and never more than three seconds. Another way to state this is that only instantaneous contact is permitted.

Application Method 1—Injection

Figure 1:
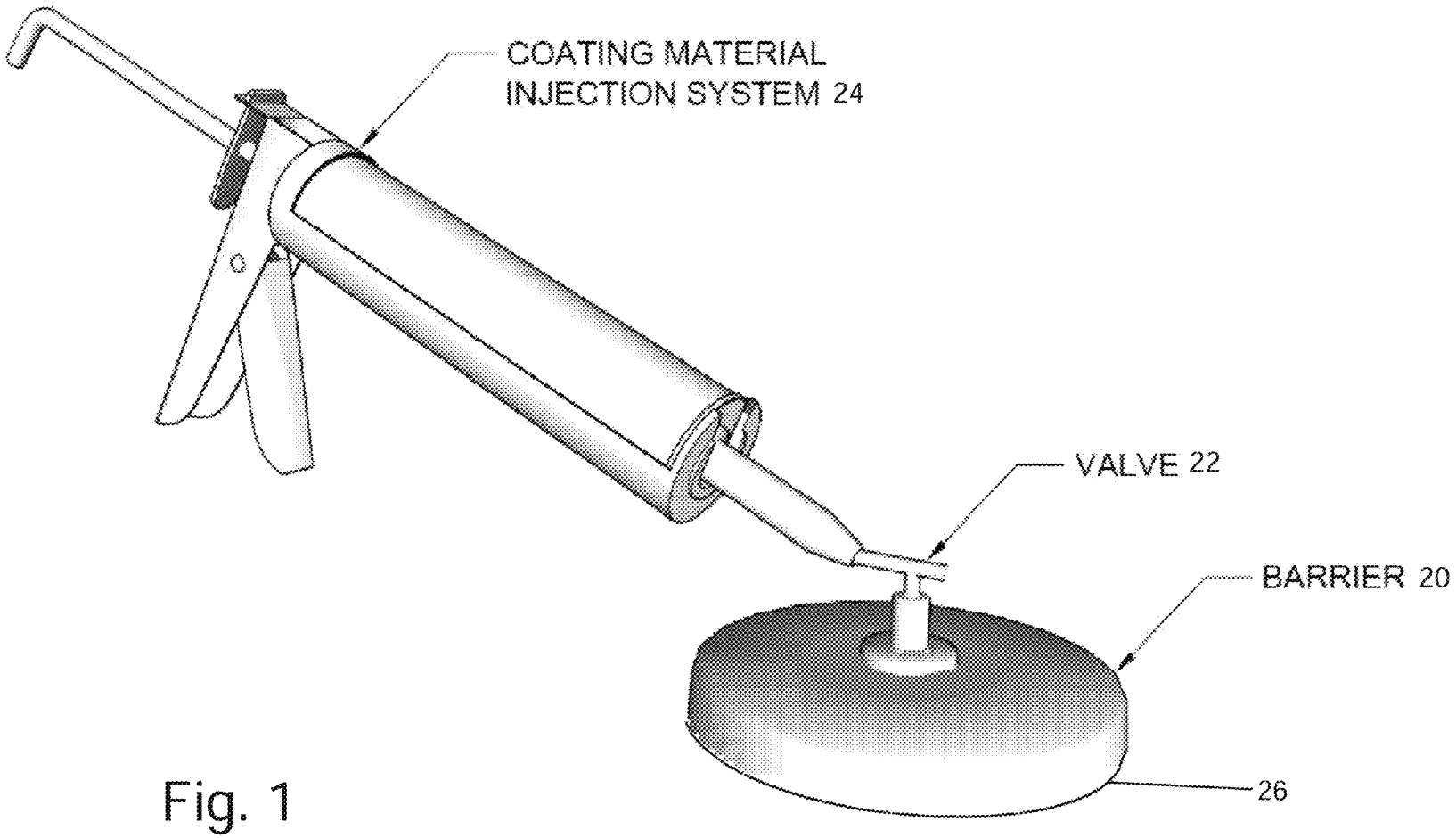
FIG. 1 is a schematic view of a system for injecting coating material into a cavity formed by a shield structure that acts as a barrier to contact with the potable water.

FIG. 1 is a schematic view of a system for injecting coating material into a cavity formed by a shield structure that acts as a barrier to contact with the potable water. A barrier shield 20 in the shape of a disk defines a cavity (not shown) for receiving the coating material. The shield 20 may be provided in a number of different shapes, though a circular generally flat disk is the most useful for covering a variety of shapes. A lower forward edge 26 of the shield 20 seal against the surface being sealed, and as such may be provided with gaskets, flexible walls, wipers or the like. (In this sense, "forward" is the direction toward the surface being sealed.) Alternatively, the forward edge 26 may be provided with a water-safe adhesive such that the shield 20 sticks to the surface and remains after the repair.

In a central upper location on the barrier shield 20, a valve 22 mounts over an aperture into the cavity. The valve 22 permits injection of the coating material into the cavity from a source of coating material, such as a caulking gun 24. The valve 22 may be a one-way valve to prevent coating material from oozing back up out of the cavity, or may be a stopcock or other such valve that can be manually closed. Of course, other means for delivering the coating material are contemplated. For instance, an epoxy supply hose or other powered device may replace the caulking gun 24. In this embodiment, there may be de minimus or instantaneous contact of a small amount of coating material at the end of the caulking gun 24 as it is removed, but the bulk of the coating material is retained underneath the barrier shield 20.

In this method of injection, the coating material is placed into a tube, bag or other container topside (prior to entering water). The container holds the coating material either in the pre-mixed state or as separate components and shields the coating material from the water. The diver or other applicator seals the barrier shield 20 against the location and covers the repair. The diver then transfers (e.g., injects) the coating material from the tube, bag or other container through a fitting or opening and through the valve 22 into the cavity between the barrier shield 20 and the substrate being repaired. The barrier shield 20 is then left in place at least as long as it takes for the coating material to cure, and may be permanently left in place to eliminate the need to remove it from the tank and speed the repair process. If the barrier shield 20 is removed, it may have a layer of non-stick or lubricious material on its inner surfaces to facilitate detachment from the cured coating material, or a separate flexible layer of plastic, for example, may line the inner surface to enable easy separation.

Application Method 2—Pre-Loaded

Figure 2:
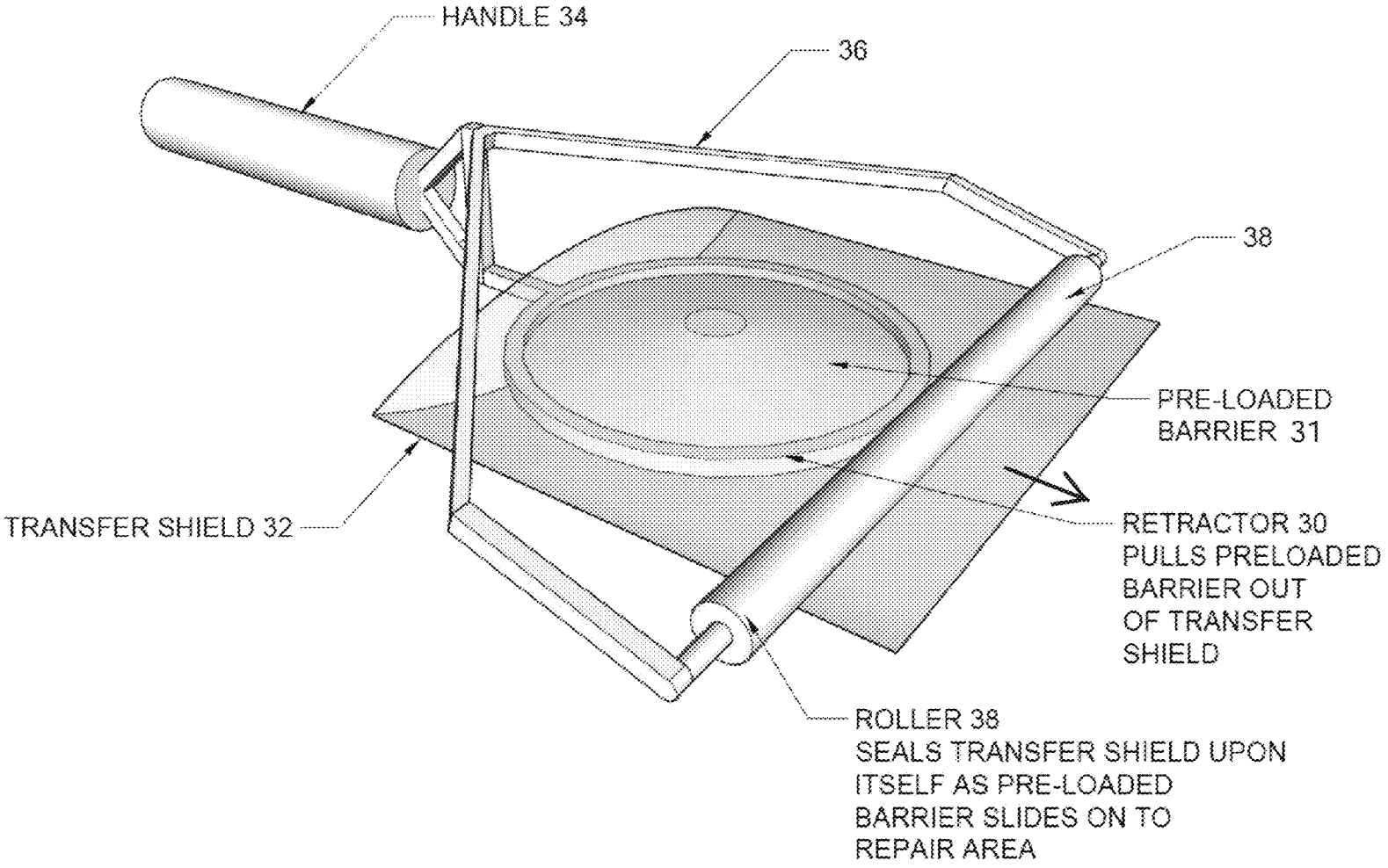
FIG. 2 is a schematic view of a system for applying coating material underneath a sheet-like barrier that is preloaded within a transfer shield.

FIG. 2 is a schematic view of a system for applying coating material underneath a shaped barrier that is pre-loaded within a transfer shield. More particularly, a circular retractor 30 surrounds a circular patch comprising 31 a circular sheet-like pre-loaded barrier having a layer of coating material therein (not shown). The retractor 30 and circular patch 31 are stored within a pocket-like transfer shield 32 which seals and maintains the usability of the coating material for a least a period of time while it is carried to the repair area. The retractor 30 may be coupled to a handle 34 used to pull the retractor from within the transfer shield 32. The handle 34 may be pre-connected to the retractor 30, or may be detachable to allow the use of the handle with a number of different retractors 30. The handle 34 also connects to an overhead frame 36 that supports on its distal end a roller 38.

As the handle 34 is held stationary the transfer shield 32 is pulled in the direction of the movement arrow, the retractor 30 exits the open end of the transfer shield and pulls the circular patch 31 with it. The leading end of the patch 31 immediately comes into contact with the surface requiring repair, and therefore no (or only de minimus) contact between the coating material and the potable water occurs. As the circular patch sticks to the area needing repair, the retractor 30 continues its movement and is separated therefrom. The roller 38 passes over and flattens the transfer shield to aid closure and minimize contact of any remaining coating material with the water as the pre-loaded patch is removed.

The pre-loading method involves the pre-application of the coating material onto the barrier layer sheet while outside of the tank, or by a manufacture. The coating material would be applied by any standard means including spatula or brush or other method. The pre-coated circular patch 31 is then placed into the enveloping bag or containment transfer shield 32 that will prevent contact of the coating material with the potable water. The enveloping bag is closed around any coating that remains on the bag as the patch is slid onto the repair area to shield the potable water from exposure to the uncured coating material.

For a pre-loaded system, the barrier and epoxy can be carried to the point of application in a bag or pouch. Application involves sliding the pre-loaded patch onto the repair location. A squeegee type tool may be used to enclose the used bag around the remaining epoxy to limit exposure to the potable water.

Application Method 3—Continuous Layer

Figure 3:
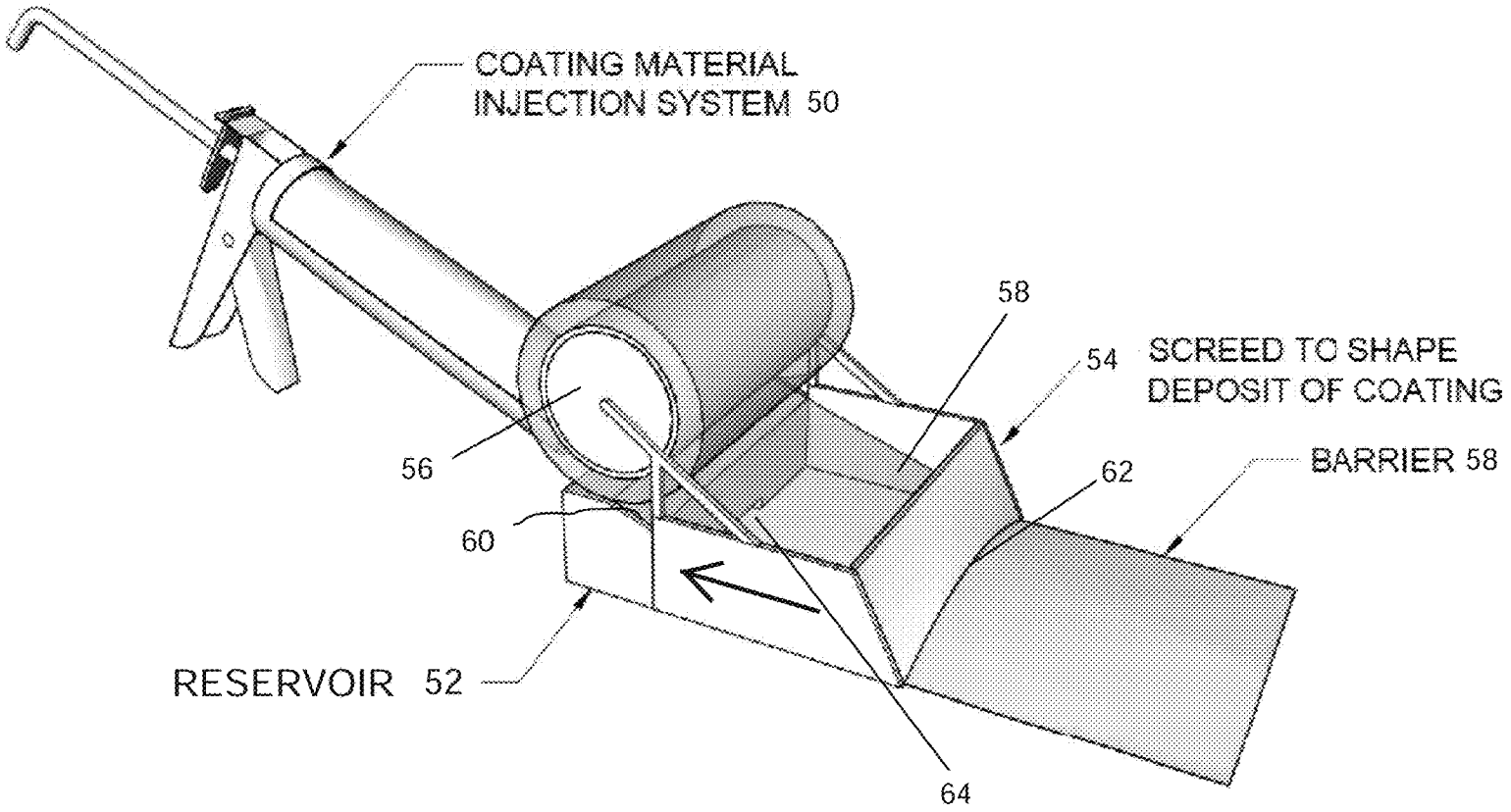
FIG. 3 is a schematic view of a system for simultaneously applying a continuous layer of coating material and a barrier layer.

FIG. 3 is a schematic view of a system for simultaneously applying a continuous layer of coating material and a barrier layer. The coating material is again applied using an injector, such as a caulking gun 50, which injects the material into a dam or reservoir 52 and under the barrier. The reservoir 52 mounts adjacent to and in fluid communication with a screed box 54. A roller 56 is positioned directly over the reservoir 52 and unspools a continuous barrier layer sheet 58 over a chamfered opening 60 of the reservoir. Movement of the system in the direction of the movement arrow occurs in conjunction with unspooling of the barrier layer sheet 58.

As the barrier layer sheet 58 unrolls it continues through the screed box 54 until it exits at a lower trailing edge 62 which is shaped to contour the coated barrier layer sheet 58 to match the particular surface being repaired. The chamfered opening 60 is angled at approximately the same angle that the barrier layer sheet 58 makes from the roller down under the lower trailing edge 62 of the screed box 54. The reservoir 52 is maintained at full capacity, and the coating material rises upward so that passage of the barrier layer sheet 58 over the chamfered opening 60 applies a layer of coating material to the barrier sheet. The lower trailing edge 62 is shown concave in this embodiment. Because the width of the barrier layer sheet 58 matches closely with the interior width of the screed box 54, there is no (or only de minimus) contact between the coating material and the surrounding potable water. The system can be used for repairing more elongated areas of the tank.

In an alternative configuration, the reservoir 52 is closed except for a lower transfer aperture 64 into a cavity of the screed box 54. Injection of coating material into the reservoir 52 forces coating material through the transfer aperture 64 and into the confines of the screed box 54, which has no lower surface. The coating material is thus applied directly to the area needing repair surrounded by the screed box 54, and movement of the assembly then presses the unspooling barrier layer sheet 58 down onto the deposited coating material. The lower trailing edge 62 presses the barrier layer sheet 58 against the tank surface and at the same time spreads the coating material laterally to result in an even thin layer under the barrier layer sheet 58.

In one embodiment, the barrier material is shaped to provide a contour to the epoxy while curing. Shapes may include flat sheet for repair on flat surfaces but epoxy material is still applied under the barrier limiting exposure to the water Preferably, no external clamping, wrapping or bagging is used to hold the patch in place.

The barrier material may contain buoyant or low density materials to provide buoyancy or support of the repair system during curing on substrates in the vertical, "overhead" or other positions where buoyancy helps support the repair during curing.

Throughout this description, the embodiments and examples shown should be considered as exemplars, rather than limitations on the apparatus and procedures disclosed or claimed.

It is claimed:

1. A method of underwater repair of an area of a potable water tank needing repair for in situ repairs with none or de minimus contact between a coating material and potable water in the tank, comprising:

providing a barrier shield having a sealing edge and defining a cavity and an aperture into the cavity, and a valve at the aperture;

pressing the sealing edge against the potable water tank with the cavity over the area needing repair;

connecting a source of coating material to the valve at the aperture;

injecting coating material into the cavity through the aperture;

removing the source of coating material from the aperture, wherein the valve prevents egress of coating material from the cavity when the source of coating material is removed from the aperture; and permitting the coating material in the cavity to cure.

2. The method of claim 1, wherein the barrier shield is disk-shaped with the aperture centrally located.

3. The method of claim 1, wherein the valve is manually actuated.

4. The method of claim 1, wherein the source of coating material is a caulking gun, tube or bag.

5. The method of claim 1, wherein the sealing edge has a gasket, a flexible wall, a wiper or an adhesive thereon for sealing against the potable water tank.

6. A method of underwater repair of an area of a potable water tank needing repair for in situ repairs with none or de minimus contact between a coating material and potable water in the tank, comprising:

providing a barrier shield having a sealing edge;

pressing the sealing edge against the potable water tank with the barrier shield over the area needing repair;

providing a source of coating material in the form of a caulking gun, tube or bag;

injecting coating material into a space between the barrier shield and area needing repair;

removing the source of coating material from the aperture; and permitting the coating material to cure.

7. The method of claim 6, wherein the barrier shield has an aperture into the space, and the step of injecting first comprises connecting the source of coating material to the aperture and injecting coating material into the space through the aperture.

8. The method of claim 7, wherein the barrier shield is disk-shaped and the aperture is centrally located in the barrier shield.

9. The method of claim 7, further comprising a valve at the aperture to prevent egress of coating material from the cavity when the source of coating material is removed from the aperture.

10. The method of claim 9, wherein the valve is manually actuated.

11. The method of claim 6, wherein the barrier shield is a disk.

12. The method of claim 6, wherein the sealing edge has a gasket, a flexible wall, a wiper or an adhesive thereon for sealing against the potable water tank.

13. A method of underwater repair of an area of a potable water tank needing repair for in situ repairs with none or de minimus contact between a coating material and potable water in the tank, comprising:

providing a disk-shaped barrier shield having a sealing edge;

pressing the sealing edge against the potable water tank with the barrier shield over the area needing repair;

providing a source of coating material;

injecting coating material into a space between the barrier shield and area needing repair;

removing the source of coating material from the aperture; and permitting the coating material to cure.

14. The method of claim 13, wherein the source of coating material is a caulking gun, tube or bag.

15. The method of claim 13, wherein the sealing edge has a gasket, a flexible wall, a wiper or an adhesive thereon for sealing against the potable water tank.

16. A method of underwater repair of an area of a potable water tank needing repair for in situ repairs with none or de minimus contact between a coating material and potable water in the tank, comprising:

providing a barrier shield having a sealing edge and defining a cavity and an aperture into the cavity, wherein the barrier shield is disk-shaped with the aperture centrally located;

pressing the sealing edge against the potable water tank with the cavity over the area needing repair;

connecting a source of coating material to the aperture;

injecting coating material into the cavity through the aperture;

removing the source of coating material from the aperture; and permitting the coating material in the cavity to cure.

17. The method of claim 16, wherein the source of coating material is a caulking gun, tube or bag.

18. The method of claim 16, wherein the sealing edge has a gasket, a flexible wall, a wiper or an adhesive thereon for sealing against the potable water tank.

19. A method of underwater repair of an area of a potable water tank needing repair for in situ repairs with none or de minimus contact between a coating material and potable water in the tank, comprising:

providing a barrier shield having a sealing edge and defining a cavity and an aperture into the cavity;

pressing the sealing edge against the potable water tank with the cavity over the area needing repair;

connecting a source of coating material to the aperture, wherein the source of coating material is a caulking gun, tube or bag;

injecting coating material into the cavity through the aperture;

removing the source of coating material from the aperture; and permitting the coating material in the cavity to cure.

20. The method of claim 19, wherein the sealing edge has a gasket, a flexible wall, a wiper or an adhesive thereon for sealing against the potable water tank.

* * * * *